252-97 AU 165 EX
6/7/77 XR 4,028,263

United States Patent [19]
Gray

[11] 4,028,263
[45] June 7, 1977

[54] BLEACHING AND BRIGHTENING DETERGENT COMPOSITION

[75] Inventor: Frederick William Gray, Summit, N.J.

[73] Assignee: Colgate-Palmolive Company, New York, N.Y.

[22] Filed: Aug. 24, 1973

[21] Appl. No.: 391,058

[52] U.S. Cl. ..... 252/99; 252/96; 252/97; 252/103

[51] Int. Cl.² ..... C11D 7/56

[58] Field of Search ..... 252/97, 99, 96, 103

[56] References Cited

UNITED STATES PATENTS

| | | | |
|---|---|---|---|
| 3,458,446 | 7/1969 | Diaz | 252/99 |
| 3,779,931 | 12/1973 | Fries | 252/99 |

OTHER PUBLICATIONS

"Oxone" E. I. Dupont, 1961, pp. 4, 6 and 8 relied on.

*Primary Examiner*—Mayer Weinblatt

*Attorney, Agent, or Firm*—Steven J. Baron; Murray M. Grill; Herbert S. Sylvester

[57] ABSTRACT

A water soluble laundry detergent containing, an organic anionic detergent, nonionic detergent or mixture thereof, a builder salt, preferably including a silicate, a peroxymonosulfate bleaching agent, a bromide promoter for the bleaching agent and one or more of certain optical brighteners which are stable in the presence of the bleach and the promoter.

The detergent composition has an excellent detersive action and is of improved bleaching efficiency compared to a non-promoted peroxymonosulfate-containing detergent. With proper selection of brightener acid or salt and judicious control of bromide and peroxymonosulfate contents in a detergent composition containing sufficient alkali to maintain a wash solution pH of at least 9, the ability of sodium bromide to promote removal of undesirable stains from a wash load of laundry is achieved with minimal adverse effect on the brightener and "colorfast" dyed fabrics are not discolored or bleached.

12 Claims, No Drawings

BLEACHING AND BRIGHTENING DETERGENT COMPOSITION

This invention relates to a bleaching and brightening detergent composition and more particularly, to a particulate laundry detergent containing a bromide-promoted peroxymonosulfate bleach and certain optical brightening agent(s).

It has long been considered desirable to incorporate in a laundry detergent a bleaching agent and an optical brightening agent, i.e., a fluorescent water soluble dye which is substantive to the fabric being washed, so as to bleach out stains and soils and at the same time, to brighten the laundered fabric. However, prior art bleaching agents have had several disadvantages which have severely limited their use in laundry detergents containing brightening agents. Many bleaching agents which contain or evolve chlorine produce offensive odors in use and hence are undesirable as components of laundry detergents. Other bleaching materials are such strong oxidizing agents that in laundry use they discolor dyed fabrics, even those dyed with so-called "colorfast" dyes. They also can cause deterioration or decomposition of the brightening agent or otherwise interfere with its brightening function. Still other prior art bleaching agents, such as inorganic peroxymonosulfate and perborate salts, are relatively weak and are inefficient for removing stains and soils when used under ordinary machine laundering conditions encountered in the United States. U.S. Pat. No. 3,458,446 teaches scouring compositions containing a detergent and a peroxymonosulfate bleach promoted by a water soluble bromide salt, such as sodium bromide. However, the abrasive constituents of the scouring compositions of the patent would preclude the use of such cleansers for washing fabrics or clothes, especially in modern washing machines, e.g., of the automatic types.

The above discussed disadvantages of the prior art are overcome by the present invention, which provides a bleaching, brightening laundry detergent, preferably in particulate form, which has a promoted bleaching action but slight, if any, deleterious effect on its preferred optical brightening constituents or on many dyed fabrics which are not adversely affected or bleached with a similar non-promoted peroxymonosulfate detergent. This novel composition comprises about 7 to 30 parts by weight of water soluble synthetic organic detergent selected from the group consisting of water soluble organic anionic detergents, nonionic detergents or a mixture thereof, preferably anionic detergent(s) or a mixture thereof with water soluble organic nonionic detergent(s) wherein the weight ratio of anionic to nonionic detergents is about 0.9:1 or 0.95:1 to 20:1, about 9 to 70 parts by weight of water soluble builder salt, about 2 to 80 parts by weight of a water soluble inorganic peroxymonosulfate salt bleaching agent, promoted by about 0.05 to 1.5, preferably 0.1 to 1.2 equivalent weights of a water soluble inorganic bromide salt per equivalent proportion or weight of active oxygen contained in the peroxymonosulfate salt or composition and from about 0.05 or 0.1 to 3 parts of an organic optical brightening agent which is stable to the peroxymonosulfate and promoter, in combination, preferably being selected from the group consisting of

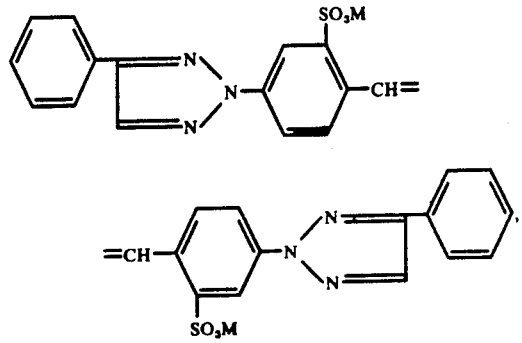

(I)

preferably wherein M is potassium (Brightener BHC), named as potassium 4,4'-bis-(4-phenyl-2H-1,2,3-triazol-2-yl)-2,2'-stilbene disulfonate,

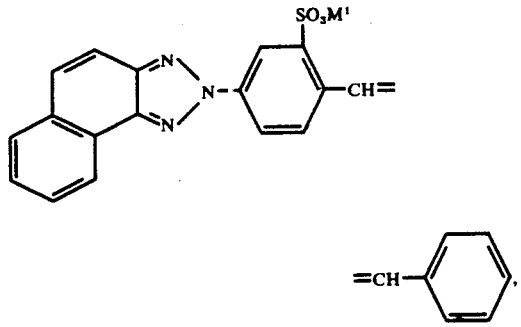

(II)

preferably wherein $M^1$ is sodium (Brightener RBS-200), named as sodium-2-sulfo-4-(2-naphtho-1,2-triazolyl)-stilbene, and the acid, 2,2'-(4,4'-divinylbiphenyl)-dibenzenesulfonic acid or a salt thereof, and

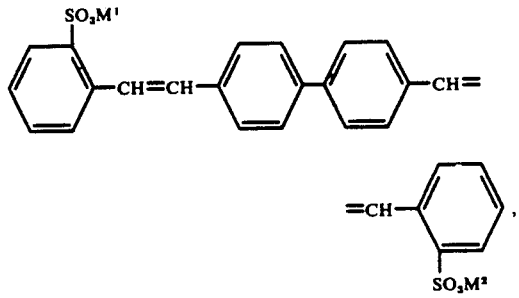

(III)

preferably wherein $M^2$ is hydrogen (Brightener CBS).

Although in the above formulas the preferred embodiments of the brighteners are given, the formula generically applies when M, $M^1$ and $M^2$ represent hydrogen or a water soluble cation, e.g., alkali metal, such as sodium or potassium, or mixtures thereof. Also, the sum of the parts will be from about 21 to 100.

The detergent composition is useful primarily for the automatic laundry machine washing of laundry, including soiled clothing and various textile materials, but may also be used as a hard surface cleaner, a bleach or a laundry presoak. It may be employed as a powder, as a powder in a premeasured envelope or soluble container or as a tablet.

The ability of a sodium bromide activated peroxymonosulfate detergent composition to bleach stained fabrics is dependent upon the amounts of bromide and peroxymonosulfate present in the detergent composition and the laundry use conditions. For strong, efficient bleach promotion, the best mole ratio of active oxygen to sodium bromide in a peroxymonosulfate detergent is at about unity, e.g. 0.9 to 1.1. Machine washing in the United States utilizes about 0.1 to 0.2% of detergent composition in a 10–20 minute machine wash cycle at 80°–140° F. In Europe, higher concentrations of detergent and higher wash temperatures, for example, 0.5 to 0.8% detergent at temperatures of 140° to 200° F. or over are common and the wash period may extend to from 0.5 to 1 hour. With the proportions of the bromide salt promoter and the peroxymonosulfate in the above described amounts, it is possible to incorporate promoted peroxymonosulfate together with the above described brightening agents into a laundry detergent which brightens and bleaches laundry efficiently. The promoted bleaching detergent composition is substantially inert toward the preferred optical brighteners described, particularly brightener BHC. In contrast, however, some brighteners are reactive and may produce a red-brown coloration of the wash solution which may not be aesthetically desirable. Moreover, fabrics washed in bromide-peroxymonosulfate detergent containing such a brightener may have unacceptable fluorescent whitening properties, as evidenced by low fluorescent intensity and a fabric color cast which is visually unattractive. It has now been found however, that the effectiveness of such and other brighteners in an oxidizing detergent composition can be significantly improved provided that the quantity of alkaline builder materials present is sufficient to maintain a pH of at least 9, preferably about 9.5, e.g., 9.0 to 10.0 or 9.3 to 10.0, during all of the wash cycle (U.S. or European). Among brighteners made useful in such ranges are Tinopal 5BM Conc. (Ciba-Geigy); Calcofluor White RC (American Cyanamid), also known as Stilbene 4; and Calcofluor CG (American Cyanamid), also known as Stilbene 3. These products are: Brightener Tinopal 5BM Conc., 4,4'-bis (4-anilino-6-methyl ethanol-S-triazin-2-ylamino)-2,2'-stilbenedisulfonic acid, disodium salt; Brightener Calcofluor White RC (Stilbene 4), 4,4'bis (4-anilino-6-morpholine-S-triazin-2-ylamino)-2,2'-stilbenedisulfonic acid, disodium salt; and Brightener Calcofluor CG (Stilbene 3), 4,4'bis (4-anilino-6-diethanol-S-triazin-2-ylamino)-2,2'-stilbenedisulfonic acid, respectively.

The use of strongly alkaline builder materials such as carbonates and silicates, in conjunction with or in the absence of phosphates has little, if any effect on the excellent bleaching ability of sodium bromide-peroxymonosulfate detergent compositions even when the pH may be in the vicinity of 10. In contrast to the use of the promoted peroxymonosulfate of this invention, certain peroxycarboxylic acids, for example, diperisophthalic acid, show a pronounced decrease in ability to bleach when sodium tripolyphosphate is replaced with carbonate or silicate to give a wash solution, the pH of which approximates 10, rather than 8.5 to 9.0. In addition to the desirability or need for a relatively high pH for efficacy of the brightener contained in the detergent, promoted peroxymonosulfate attack on prebrightened relatively new fabrics or fabrics which have retained brightener from prior wash treatments is likely to be noted if the pH is less than 9.

Preferably the detergent composition of the invention contains about 0 or 5 to 50 parts of a water soluble halide anion-free filler salt, such as sodium sulfate, 5 to 30 parts of an alkali metal silicate, 0 to 30 parts of sodium carbonate and about 0.1 to 10 parts of moisture, with the sum of the parts being from about 26 to 160 parts by weight when such are also present.

Preferably also the total materials in the present composition other than those constituents recited above is less than about 20% by weight.

In a preferred embodiment of the invention, the detergent composition contains 7 to 30%, especially 9 to 20%, of synthetic organic detergent which is a mixture of anionic detergent(s) and nonionic detergent(s) in a weight ratio of 3:1 to 15:1; 5 to 30%, especially 7 to 20%, of alkali metal silicate, 9 to 70%, especially 20 to 65%, of other builder salt, 5 to 50% of filler salt, 5 to 40%, especially 6 to 30% of peroxymonosulfate salt, containing about 4 to 5% of active oxygen, promoted by 0.1 to 1.2 equivalents of bromide salt per equivalent of active oxygen in peroxymonosulfate salt, 0.2 to 2.5% of stable optical brightener, 2 to 5 or 8% water and with the total amount of adjuvant materials in the composition being less than about 15%, especially preferably being about 0.1 to 10%.

The detergent compositions of the invention include as a primary detersive constituent a water soluble synthetic anionic detergent salt selected from the group consisting of organic sulfonates, sulfates, phosphates and phosphonates, the detersive action of which can be supplemented, or if desired, replaced entirely by water soluble organic nonionic detergent(s). Such suitable detergents are described in *McCutcheon's Detergents and Emulsifiers* 1969 *Annual* wherein such compounds are listed by chemical formulas and trade names. Additional suitable detergents of the aforementioned types are also described in the test *Surface Active Agents and Detergents*, Vol. II, by Schwartz, Perry and Berch (Interscience Publishers, 1958). In short, useful anionic materials include hydrophilic and lipophilic groups, the lipophilic portions of which normally contain a higher hydrocarbyl chain, usually of 10 to 20 carbon atoms and the hydrophilic portions of which include a salt-forming ion, preferably an alkali metal cation and an acid group of the mentioned class. Among such useful detergents the organic sulfonates and sulfates are preferred (especially the former) according to the invention, but corresponding organic phosphonates and phosphates are also useful. Suitable anionic detergents, include, for example, the linear higher alkyl benzene sulfonates; the branched chain higher alkyl benzene sulfonates (these are not usually sufficiently biodegradable to be accepted in modern detergent formulations); the higher olefin sulfonates; the higher alkyl sulfonates; higher paraffin sulfonates; higher alcohol sulfates, including sulfated derivatives of higher polyhydric alcohols which are incompletely esterified with higher fatty acids; and the sulfates of condensates of higher alcohols and lower alkylene oxides and glycols, i.e., alkylene oxides and glycols of 2 to 4 carbon atoms such as ethylene oxide, propylene oxide, ethylene glycol, butylene glycol and the like. The higher hydrocarbyl, alkyl and higher fatty acyl groups of such compounds will generally be of 12 to 18 carbon atoms and the salt-forming cations thereof will preferably be alkali metal cations, e.g., sodium and potassium, with ammonium, amines and alkanolamines sometimes also being useful. The sodium salts tend to make harder detergent products which are more freely flowing and have less tendency to cake.

Among the preferred organic sulfonate detergents, linear higher alkyl aromatic sulfonates, preferably those wherein the aromatic group is phenyl, are utilized and linear tridecyl benzene sulfonate, usually as the sodium salt, is especially preferred. Of these materials it is highly preferred to employ the linear higher alkyl benzene sulfonates wherein the alkyl substituents are of 12 to 18 carbon atoms, especially of 12 to 15 carbon atoms, and in which the salt-forming cation is alkali metal, especially sodium. However, the alkali metal sulfates of lower alkoxylated, e.g., ethoxylated, higher fatty alcohols and middle ($C_{7-9}$) alkyl phenols are also very useful. In such compounds there will usually be from 3 to 20 lower alkoxy groups present.

The nonionic detergents employed in certain of the above-described preferred embodiments of the invention are usually poly-lower alkoxylated lower alkanols of lipophilic moieties, wherein the lower alkoxies and alkanols are of 2 to 3 carbon atoms, preferably 2, and the lipophiles are higher alkanols, middle alkyl (7 to 9 carbon atoms) phenols or polypropylene oxide condensates. They include higher alkyl poly-lower alkoxylates or, in other words, higher alkyl poly-lower alkoxy alcohols, i.e., the condensation products of higher fatty alcohols with lower (2–4 carbon atoms) alkylene glycols and/or with lower alkylene oxides, such as ethylene oxide or propylene oxide, as exemplified by Neodol 45-11,Plurafac B-26 and Alfonic 1618-65. Such products are normally liquid or semi-solid at room temperature. Also useful are the block copolymers of propylene glycol, propylene oxide and ethylene oxide, such as those sold as Pluronics, e.g., Pluronic F-68, and the middle alkyl phenyl polyoxyethylene ethanols, such as those sold as Igepals. Preferably, the nonionic detergent that will be utilized in the invention is a higher linear alkyl polyethoxy ethanol. The number of carbon atoms in the higher alkyl groups averages from 10 to 18, preferably from 12 to 15, and especially from 14 to 15 and the molar ratio of ethoxy groups to higher alkyl groups is usually from 7 to 20, preferably 9 to 13 and especially preferably is about 11.

The builder salts which are employed in the invention are well known in the laundry detergent art and generally exert a desirable effect in overcoming water hardness and in increasing the cleaning ability of the organic detergent. They also help to impart a desirable alkaline pH, in the present products (generally about 8 and advantageously about 9 to 10, e.g., about 9.5), to wash water. Suitable builder salts include water soluble salts having "inorganic" anions, e.g., pyrophosphates, tripolyphosphates, orthophosphates, silicates, borates, carbonates, sesquicarbonates, bicarbonates and the like, as well as water soluble salts having organic anions, such as tartrates, citrates, gluconates and other hydroxy acids. Nitrogen-containing sequestrants and builders, such as NTA, EDTA and hydroxyethyliminodiacetates are usually avoided because of stability problems encountered but may sometimes be used in suitable formulations. The cations associated with the above described inorganic and organic anions in the builder salt are preferably alkali metal cations, e.g., sodium and/or potassium. Preferable builder salts of the invention are selected from the readily available and inexpensive pyrophosphates, e.g., tetrasodium pyrophosphate; tripolyphosphates, e.g., pentasodium tripolyphosphate; citrates, e.g., sodium citrate; bicarbonates, e.g., sodium bicarbonate, potassium bicarbonate; carbonates, e.g., sodium carbonate, potassium carbonate and silicates, e.g., silicates having an $Na_2O:SiO_2$ ratio of 1 to 2.4, but various other builders known in the art, preferably nitrogen-free, are also useful.

The bleaching agent utilized in the present detergent composition is a water soluble peroxymonosulfate salt and generally is an alkali metal peroxymonosulfate, such as a sodium or potassium peroxymonosulfate. Conveniently, a potassium peroxymonosulfate salt may be used, especially the readily available potassium peroxymonosulfate salt sold under the trademark, Oxone, by E. I. DuPont de Nemours and Company, Inc., having the formula $2KHSO_5.KHSO_4.K_2SO_4$, which material is characterized by an active oxygen content of about 4.5%. Alternatively, the corresponding sodium salt or mixtures are used.

The water soluble bromide salt employed in the invention to promote the peroxymonosulfate bleaching agent is preferably an alkali metal bromide, such as sodium or potassium bromide. Sodium bromide, being very effective, readily available and inexpensive, is especially preferred.

The use of an inert, water soluble filler salt is desirable in the present laundry detergent formulation. In such products the filler salt charged, in accordance with a preferred embodiment of the invention, should be free of halide anions. On dissolution in aqueous media none of it should ionize to chloride or bromide anions. In the presence of the peroxymonosulfate salt bleaching agent chloride anion may be oxidized to elemental chlorine, which is usually undesirable. Also, bromide anion produced from the filler would be in excess of the bromide promoter charged as water soluble bromide salt and might overpromote the monopersulfate bleach, possibly producing deleterious effects on the optical brightener constituents and/or on dyed fabrics being washed. A preferred halide anion-free filler salt is an alkali metal sulfate, e.g., sodium or potassium sulfate. Sodium sulfate is especially good and is usually present in the product in anhydrous form (or only to a minor extent as hydrate).

The preferred optical brighteners of the invention contained in the bromide-promoted peroxymonosulfate detergent composition are highly resistant, essentially inert to deterioration by the bleaching agent, either during storage or during use of the product. It has been found that the brightener which is the dipotassium salt 4,4′-bis-(4-phenyl-2H-1,2,3-triazoyl-2-yl)-2,2′-stilbene disulfonic acid (Formula I), available commercially from Verona Dyestuff Division of Verona-Pharma Chemical Corporation under the name Phorwite BHC-766, and the brightener, sodium-2-sulfo-4-(2-naphtho-1,2-triazolyl)-stilbene (Formula II), sold as Tinopal RBS by Ciba-Geigy Chemical Corporation, are especially suitable in the present products. Their stabilities and effectivenesses remain high in the present compositions in wash water at pH's as low as 8 and as high as 10.

For reasons of availability, economy, obtaining a wide range of substantivity toward fabrics or for more aesthetic hue characteristics, it may be desirable to use a combination of brighteners. Under such circumstances brightener CBS (Formula III) which is 2,2′(4-,4′-divinylbiphenyl)-dibenzenesulfonic acid, is highly effective provided that the composition has sufficient alkali so that a wash solution thereof produces a pH of 9 or more throughout the wash cycle. Alternatively, the relatively low cost conventional triazinylamino-stilbene disulfonate brightener(s) may be present but if so, the wash solution of the composition should usually have a high pH, preferably about 10. Examples of the relatively inexpensive triazinyl stilbene brighteners which may be used, usually in a total proportion of 1:100 to 100:1, preferably 1:4 to 4:1, and more preferably about 1:1, with respect to the other brighteners previously mentioned (BHC-766, RBS and CBS), are Tinopal 5BM Conc., Calcofluor White RC and Calcofluor CG. Of these the RC (Stilbene 4) is preferred. Because the fluorescent dyes are characterized by strong substantivity to a variety of fabrics with ability to absorb light strongly in the ultraviolet region and re-emit the energy thereof as visible radiation, their presences on the fabrics after laundering produce desirable increases in the apparent whitenesses of washed fabrics. The effectiveness of the preferred brighteners on washed fabrics is not adversely affected by the action of promoted peroxymonosulfate but for those brighteners which are subject to deterioration, the adverse effect is minimized considerably by formulating the composition so that the wash solution thereof is at a pH of about 10 (for 5BM, RC and CG).

An important constituent of the detergent compositions of the invention is the alkali metal silicate component. Such compounds are water soluble and are useful as builders for synthetic organic detergents. They also exert alkalinizing effects, inhibit corrosion, help to counteract water hardness and have both an independent detersive effect and the property of improving the detersive properties of the anionic and nonionic detergents utilized in the present invention. The alkali metal silicates which are preferred constituents of the present detergent compositions have the formula $M_2O:SiO_2$, wherein M represents alkali metal, e.g., sodium or potassium, most preferably sodium, and the ratio of $M_2O:SiO_2$ is preferably in the range of 1:1 to 1:3, more preferably 1:2 to 1:2.4 and especially about 1:2.35.

Together with the foregoing components of the present bleaching, brightening laundry detergent, there may be present in a total amount up to 20%, preferably up to 15% and more preferably, 0.05 to 10% of the composition, additional minor adjuvants which impart certain functional or aesthetic properties to the product. In general, the concentration of each of these minor adjuvants is quite small, i.e., about 0.05 to 2% by weight of the composition. Minor adjuvants include perfume; water soluble dyes; water dispersible pigments; long chain fatty acid soaps, i.e., alkali metal salts of $C_{10}$ to $C_{18}$ alkanoic and alkenoic acids, such as tallow and coconut oil fatty acids, the former types being especially useful as antifoaming agents and detergents; organic gum anti-redeposition agents, such as the alkali metal carboxymethyl cellulose salts, especially sodium carboxymethyl cellulose, polyvinyl alcohol, polyvinyl pyrrolidone and polyacrylamide; foam improvers, such as lauric myristic diethanolamide; foam destroyers, such as silicones; fungicides, such as the polyhalosalicylanilides; flow improving agents, such as the clay product commercially sold under the trade name "Satintone"; and an odor stabilizer or malodor-inhibitor, such as Iphol. Iphol is a mixture of 2-methyl-4-isopropyl phenol and 2-methyl-6-isopropyl phenol, the product of the reaction of orthocresol with isopropanol in the presence of phosphoric acid. Of course, the adjuvant materials will be selected for the properties desired in the finished detergent product and to be compatible with the other constituents thereof.

The present composition is advantageously prepared by commingling in an aqueous medium, with agitation, all of the constituents except the peroxymonosulfate salt and any perfume to be added. Conveniently the agitation can be accomplished in a conventional soap crutcher over a suitable time period, e.g., 3 minutes to 1 hour, at a temperature ranging from room temperature or a moderately elevated temperature to about 80° or 90° C. The aqueous mixture is then converted to a particulate solid by spray drying. According to a normally employed spray drying technique the aqueous mixture is forced through restricted orifices, for example of cross-sectional areas equivalent to a circular passage of 1 to 5 mm. in diameter, at a high pressure, e.g., 200 to 1,000 lbs./sq. in., so as to result in production of a spray of aqueous droplets. The droplets are allowed to fall through a spray drying tower, wherein they are contacted with a countercurrent or concurrent flow of hot drying air. The drying air entering the spray drying tower will be of an initial temperature in the range of about 200° to 500° C. and at exit from the tower will usually be about 110° to 200° C. The drying operation will be controlled, as by regulation of drying gas temperatures and tower throughput rates, to make detergent particles of a desired moisture content, generally in the range of about 2 to 10%, preferably 4 to 10%, e.g., 4 to 6%. It is then preferred for the spray dried particles to be screened and sized to obtain product particles in about the 6 to 140 mesh range (U.S. Standard Sieve Series). Preferably, the product will pass completely through a U.S. No. 8 screen and no more than 10% will pass through a U.S. No. 100 screen. Also preferably, it will have a cup weight of between 50 and 150 grams; more preferably about 75 grams, which correspond to bulk densities of 0.21 to 0.63 g./ml., preferably 0.32 g./ml. At this point, if desired, perfume may be added by spraying onto the detergent and a desiccant material such as sodium sulfate or magnesium sulfate may be added. Any other adjuvants which are sensitive to elevated temperature, particularly in aqueous media, or part or all of any constituent of the composition, for example, sodium bromide, may be added after the spray drying step if it is considered advantageous to do so with respect to the particular formulation. The particulate product is then charged to a tumbling drum for admixing with the peroxymonosulfate salt whose particle size will preferably approximate that of the base detergent to which it is being added. Flow-improving clay, e.g., Satintone, may also be added.

When tested by laboratory wash tests and in practical automatic laundry tests it is found that the present particulate detergent products are excellent detergents, effectively washing out soils of the various types normally encountered, such as particulate soils, clays, sebum or sebaceous soils, greasy deposits and carbonaceous soils, from cotton and synthetic organic fibers and fabrics, e.g., nylons, polyesters, acetates, synthetic blends, cotton-synthetic blends, and permanently pressed items. The present detergents are particularly effective in bleaching out strong food stains such as coffee and tea stains. In general the bleaching efficacy of the present compositions containing the promoted bleach is much better than that of the corresponding detergent devoid of the promoter.

The present compositions can be used to wash and brighten naturally stained white laundry by use of concentrations which are dependent upon whether the load is lightly or heavily soiled and stained. When so-called "colorfast" dyed fabrics are also present in the wash, safe usage of the composition will be dependent to an extent upon the type(s) and quantities of soil(s) on the fabrics, upon the concentration of peroxymonosulfate and bromide, and on the alkalinity of the wash solution. Thus, for example, concentrations of detergent to provide as much as 12 to 17 p.p.m., preferably about 14 p.p.m. of active oxygen derived from peroxymonosulfate and 80 to 110 p.p.m., preferably 90 p.p.m., of sodium bromide in the laundry water at a pH of about 9.5 can effectively clean, bleach and brighten soiled and stained fabrics without appreciable effect on the shade or tint of dyed fabric, indicative that the present promoted bleach constituent of the detergent preferentially attacks stains and soils, rather than dyestuffs. To prevent localized bleach overconcentrations, care is exercised that when the detergent product is added to the water agitation is started immediately, preferably before such addition.

The following examples illustrate the invention but do not limit it. Unless otherwise indicated, all parts are by weight and temperatures are in °C. herein.

EXAMPLE 1

A spray dried detergent product (A) having the following composition is prepared, using the standard spray drying conditions previously described.

| | Percent |
|---|---|
| Linear sodium alkylbenzenesulfonate with the alkyl group of 12–15 carbon atoms, averaging about 13. | 25.0 |
| Neodol 45–11 (a primary alkanol of 14–15 carbon atoms ethoxylated with 11 moles of ethylene oxide per mol of alkanol), made by Shell Chemical Co. | 4.0 |
| Sodium soap (a mixture of coconut and tallow fatty acid salts in an acids ratio of about 15:85) | 1.0 |
| Sodium silicate ($Na_2O:SiO_2$ ratio = 1:2.35) | 25.0 |
| Sodium carboxymethyl cellulose (CMC) | 2.0 |
| Brighteners: Tinopal 5BM Conc. | 0.70 |
| Stilbene 4 | 0.23 |
| Tinopal RBS-200 | 0.05 |
| Sodium sulfate | 35.0 |
| Water | 5.0 |
| Minor adjuvants [0.1 to 1% each of dye, perfume (0.38%) stabilizer (to prevent development of odor) and anti-caking agent] | q.s. |

The product is of 8 to 140 mesh particle size with less than 10% passing a 100 mesh sieve. The perfume is sprayed onto the tumbling beads after cooling thereof after spray drying. Particle sizes remain the same.

The foregoing detergent composition (A) is used to prepare the following bleach compositions:

| | Parts | | |
|---|---|---|---|
| Composition Ingredients | (I) | (II) | (III) |
| Detergent A | 1.23 | 4.10 | 4.10 |
| Peroxymonosulfate (4.5% active oxygen), potassium salt (Oxone) | 0.15 | 0.50 | 0.50 |
| Sodium bromide | 0.045 | 0.15 | 0.00 |
| Sodium sulfate | 0.075 | 0.25 | 0.25 |

In a Tergotometer test washing machine, set at 48° C. and 100 r.p.m., the above bleach compositions, each previously dry blended, are separately added to 1 liter of 48° C. tap water of about 100 p.p.m. hardness (as $CaCO_3$). In separate washings three (3 × 6 inches) swatches of coffee-tea stained cotton and three (3 × 6 in.) blue dyed swatches (from a Monticello Blue No-Iron Percale Sheet) are washed in these solutions for 15 minutes (6 washes). After rinsing and drying, increases in reflectance (ΔRd) are calculated from Rd values recorded for swatches before and after washing, on a Gardner Color Difference Meter, and in the case of colored fabrics, "b" readings are also taken to obrain Δb values. The wash waters of compositions containing bromide are red-brown in the first part of the wash period and no color development is noted for the non-promoted detergent. The pH's of the compositions upon completion of the washes are 9.5±0.1.

The data in Table I, which follows, show that Compositions (I) and (II), wherein detergent (A) contains peroxymonosulfate (K salt) promoted with sodium bromide are much better for bleaching of coffee-tea stained fabrics than is Composition (III) wherein the promoter is omitted. It is to be noted that Composition (III) is used at about 0.5% concentration and its wash solution can provide theoretically about 22 p.p.m. of active oxygen whereas Composition (I) is used at about 0.2% concentration and its wash solution can provide theoretically only about 7 p.p.m. of active oxygen. This improved ability of Composition (I) to bleach oxidizable stain when used at about 0.2% concentration does not appear by either visual or instrumental evaluation to significantly bleach or alter the color cast of the dyed fabric tested. On the other hand, the use of Composition (I) at 0.5% concentration (of Composition (II) results in a slight alteration in the color of the blue dyed fabric, as indicated by the instrumental readings, but bleaching of coffee-tea stain is greater than obtained for Composition (I) or Composition (III).

TABLE 1

| | Coffee-Tea | | Blue Percale | | | |
|---|---|---|---|---|---|---|
| Composition | Final Rd | ΔRd | Final Rd | ΔRd | Final b | Δb |
| I | 86.6 | 16.0 | 44.8 | 0.6 | −18.6 | 0.5 |
| II | 89.1 | 17.8 | 45.7 | 1.3 | −18.3 | 0.8 |
| III | 81.0 | 9.6 | 45.5 | 0.5 | −19.0 | −0.1 |

In the preceding formulas comparably good results are obtained when the brightener composition is changed to equal proportions of Stilbene 4 and RBS-200, e.g., 0.2% of each.

EXAMPLE 2

A spray dried detergent formula (B) having the following approximate composition is prepared by the method described in Example 1.

| | Percent |
|---|---|
| Linear sodium alkylbenzenesulfonate (alkyl group averaging about 13 carbon atoms) | 10.0 |
| Neodol 45–11 | 2.0 |
| Sodium soap (a mixture of coconut and tallow fatty acid salts of a 15:85 coconut oil:tallow mix) | 1.0 |
| Sodium silicate ($Na_2O:SiO_2$ = 1:2.35) | 7.0 |
| Tetrasodium pyrophosphate | 38.0 |
| Sodium carboxymethyl cellulose | 0.5 |
| Phorwite BHC 766 (Veronal) | 0.28 |
| Water | 7.5 |
| Perfume | 0.3 |
| Sodium sulfate | q.s. |

The foregoing detergent (B) is used in place of detergent (A) to form Compositions (IV) and (V), corresponding with Compositions (II) and (III) of Example 1. Wash test experiments under conditions identical to those described in Example 1 give similar results for the bleaching of coffee-tea stained fabrics and blue dyed fabrics (Table II). In contrast to Example 1, the wash waters obtained from Compositions (IV) and (V) are colorless throughout the test. The pH of both wash solutions is 9.6 upon completion of the washing operation.

TABLE II

| Bleach Composition | Coffee-Tea Final Rd | Coffee-Tea ΔRd | Blue Percale Final Rd | Blue Percale ΔRd | Blue Percale Final b | Blue Percale Δb |
|---|---|---|---|---|---|---|
| IV (with sodium bromide) | 89.4 | 17.8 | 46.2 | 1.6 | −17.8 | 1.2 |
| V (without sodium bromide) | 81.8 | 10.3 | 45.1 | 0.6 | −19.2 | −0.1 |

EXAMPLE 3

The following bleach-detergent compositions, each of which has added 0.33 g. of peroxymonosulfate (4.5% active oxygen) are prepared: (VI) 4.57 g. detergent (A) of Example 1; (VII) 4.57 g. detergent (A) of Example 1 plus 0.10 g. of sodium bromide; (VIII) 4.57 g. of detergent (B) of Example 2; and (IX) 4.57 g. detergent (B) of Example 2 plus 0.10 g. of sodium bromide. Each composition is added to a Tergotometer testing apparatus and is agitated for two minutes in 1 liter of water at 48° C. To each aqueous solution is added a 15 × 15 inch clean non-brightened white cotton percale swatch. After being agitated in the detergent solution for 15 minutes the swatches are removed, rinsed and dried. The fluorescence intensities of the swatches are measured with a Gardner instrument and the swatches are found to have increased fluorescence intensity values ($\Delta R_B$) as follows: (VI) 361; (VII) 288; (VIII) 364; (IX) 355.

The active oxygen content for all solutions is 15 p.p.m. The solution of composition VII exhibits a red discoloration which endures for about 7 minutes. Discoloration of water does not occur for the other compositions.

EXAMPLE 4

In this example, a spray dried detergent (C) of the commercial Fab type but without brightener or anti-redeposition agent is prepared. Its composition is essentially 21.0% linear sodium tridecylbenzenesulfonate, 35.5% sodium tripolyphosphate, 7.0% sodium silicate ($Na_2O:SiO_2$ =1:2.35), 1.0% borax, 27% sodium sulfate and 8.5% water. To 4.60 grams of (C) are added (XX) 0.33 g. of peroxymonosulfate (4.5% active oxygen) and (XXI) 0.33 g. of peroxymonosulfate plus 0.10 g. of sodium bromide. Three coffee-tea stained swatches are bleached by the same procedure described in Example 1. No development of color is noted to occur in the washes and the pH of the solutions is held at 9.0±0.1. Fabric washed in (XX) has a final Rd value of 81.4 and a ΔRd value of 8.6 while fabric washed in the bromide promoted composition (XXI) has a final Rd value of 89.1 and a ΔRd value of 16.4.

EXAMPLE 5

The detergent composition (C) of Example 4 is used in testing the characteristic and efficacies of various brighteners in the presence of peroxymonosulfate promoted with sodium bromide. The detergent without brightener (4.60 g.) is supplemented with various brighteners (0.03 g.) and peroxymonosulfate (0.33 g.), with and without sodium bromide (0.10 g.). The total compositions, approximately 5.0 g., are added to 1 liter measures of 48° C. tap water contained in a Tergotometer test instrument and a 15 inch by 15 inch clean, non-brightened white percale swatches are quickly added and agitated at 100 r.p.m. for 15 minutes. The solutions are observed for development of color and after rinsing and drying, color values for the various brighteners on the fabric are measured with a Gardner Color Instrument and are recorded.

TABLE III

| Brightener | Without NaBr $\Delta R_B$ | Without NaBr Δa | Without NaBr Δb | With NaBr $\Delta R_B$ | With NaBr Δa | With NaBr Δb |
|---|---|---|---|---|---|---|
| BHC 766 | 367 | 1.8 | −6.2 | 367 | 1.9 | −6.3 |
| RBS 200 | 278 | 1.3 | −4.4 | 268 | 1.2 | −4.4 |
| 5BM | 361 | 1.8 | −5.9 | 176 | 0.9 | −2.6 |
| CBS | 383 | 1.9 | −5.8 | 341 | 1.7 | −5.1 |
| Stilbene No. 3 | 372 | 2.0 | −6.2 | 198 | 1.1 | −2.8 |
| Stilbene No. 4 | 355 | 2.0 | −5.9 | 198 | 1.1 | −3.1 |

TABLE IV

| Brightener | Color |
|---|---|
| CBS | None |
| RBS 200 | None |
| BHC 766 | None |
| Stilbene No. 3 | Orange for 2.5 min. (with NaBr) |
| Stilbene No. 4 | Very pale pink for 2.5 min. (with NaBr) |
| 5BM | Red for 4 min. (with NaBr) |

EXAMPLE 6

A spray dried detergent (D) containing the same type and quantity of detergent composition as in Example 2 is prepared with the exception that the 38% sodium pyrophosphate content of detergent (B) of Example 2 is replaced by 35% of sodium tripolyphosphate and 3% of sodium sulfate. Also, the brightener BHC-766 is replaced with 0.14% BHC-766 and 0.14% CBS. The ability of detergent (D), fortified with peroxymonosulfate and sodium bromide, to bleach coffee-tea stain is about the same as observed for detergent (B) when formulated similarly with peroxymonosulfate and promoted with bromide compound. Similar results are obtained when sodium carbonate is substituted for the silicate present in the composition, but the anti-corrosion properties of the silicate are not obtained.

EXAMPLE 7

Five dry, granular bleach compositions each of which consists of Detergent (D) of Example 6 formulated with 10% of potassium peroxymonosulfate (4.5% active oxygen) and from 0.7 to 3% of sodium bromide, are made. Each composition, designated (XI) through (XV), is added to 1 liter of 48° C. tap water in a Tergotometer instrument to give solutions of 0.15% concentration. Each solution provides 7 p.p.m. of active oxygen (A.O.) and the sodium bromide concentrations in p.p.m. are: (XI) 0; (XII) 10; (XIII) 20; (XIV) 30; and (XV) 45. Immediately after additions of the test compositions to the water, test swatches, measuring 3 inches by 6 inches of dyed fabric, identified as 1. Cotton: 5% Calcoloid Blue
2. Cotton: 10% Calcogene Brilliant Blue 5GCF
3. Spun Nylon: 1.0% Calcocid Milling Yellow R are introduced. For each test, three swatches of a particular color are washed for 15 minutes. The solutions do not develop color and upon completion of the wash period they have a pH range of from 8.4 to 8.9.

As confirmed by the results given in Table V, it is apparent visually that some damage to the color of dyed fabrics (1) and (2) occurs with Compositions (XIII), (XIV), and (XV), whereas damage to dyed fabric (3) is only apparent with Composition (XV), containing 3% of sodium bromide.

TABLE V

| Compositions | (1) Cotton Calcoloid Blue | | | (2) Cotton Calcogene Blue | | | (3) Spun Nylon Calcocid Yellow | | |
|---|---|---|---|---|---|---|---|---|---|
| | ΔRd | Δb | pH | ΔRd | Δb | pH | ΔRd | Δb | pH |
| XI | −0.1 | 0.0 | 8.8 | −0.1 | +0.2 | 8.9 | −0.2 | −0.5 | 8.8 |
| XII | +0.1 | +0.2 | 8.7 | 0.0 | +0.7 | 8.7 | −0.4 | −0.7 | 8.5 |
| XIII | +0.4 | +0.9 | 8.5 | +0.5 | +3.5 | 8.7 | −0.5 | −1.0 | 8.5 |
| XIV | +0.4 | +1.2 | 8.6 | +0.9 | +4.8 | 8.6 | −0.1 | −1.0 | 8.4 |
| XV | +0.5 | +1.6 | 8.5 | 1.3 | +6.2 | 8.5 | +0.7 | −1.1 | 8.5 |

EXAMPLE 8

To the peroxymonosulfate detergent product containing about 2% sodium bromide (Formula D, Example 7) is added about 10% of sodium carbonate. Bleach tests conducted with coffee-tea stained fabric under the Tergotometer test conditions described in Example 1 are highly satisfactory. When Example 7 is repeated, the solution pH after completion of the wash is 9.4±0.1 and the bleaching or adverse change in color for the dyed fabrics is practically nil, using this composition.

EXAMPLE 9

Practical laundry testing of six-pound loads of white laundry that have been stained and soiled under ordinary home use is conducted. In addition, the laundry contains two coffee-tea stained cloths, an Empa bleach test cloth 155, (U.S. Testing Company) and a non-brightened white percale swatch, each of which are 15 inch squares. The laundry, with the test swatches, is washed for 10 minutes in a Kenmore automatic washing machine. Peroxymonosulfate detergents with sodium bromide (XVI) and without sodium bromide (XVII) are used at 0.2% concentration in 17 gallons of 120° F. wash water of 150 p.p.m. hardness, as calcium carbonate. The weight of composition (XVI) is 131 g. and consists of 73.3% detergent D, 14.7% peroxymonosulfate (4.5% active oxygen, 4.4% sodium bromide and 7.6% sodium carbonate. Composition (XVII) contains 76.7% detergent D, 15.3% peroxymonosulfate (4.5% active oxygen), 8.0% sodium carbonate, and weighs 125 g. Upon completion of the wash, the pH's of the solutions are about 9. Both visually and instrumentally, the laundry, coffee-tea stained fabric, Empa bleach test cloths and white percale washed with (XVI) are bleached to a much greater extent than are the corresponding laundry items or swatches washed with (XVII). The fluorescent brightening intensity for the white percale swatch washed in (XVI) is about 25% lower than its counterpart washed with (XVII).

EXAMPLE 10

The practical laundry test of Example 9 is repeated except detergent B of Example 2 replaces detergent D and three test swatches (5 inch squares) cut from each of the following dyed fabrics are included in the wash.

1. Cotton, dyed with 5% Calcoloid Blue BLR;
2. Spun Nylon, dyed with 1% Calcocid Alizarine Blue SAPG;
3. Spun Nylon, dyed with 1% Calcocid Milling Yellow R; and
4. 50% Polyester, 50% Cotton, dyed pink (Pink Pillowcase Material, J.C. Penney).

Upon completion of the 10 minute wash in the Kenmore machine, the pH of the wash solution with bromide (XVIII) is 9.3, while that of solution without bromide, (XIX) is 9.4. The better bleaching ability of (XVIII) over (XIX) for coffee-tea stained and Empa 115 swatches is of about the same magnitude as observed in Example 9. The brightening intensity for the test swatch washed with (XVIII) is about 86% of that obtained for its counterpart swatch washed with (XIX) and is 92% of that obtained for the swatch washed with (XVII) of Example 9. The four differently dyed swatches are not adversely affected by washing with Compositions (XVIII) and (XIX).

In the procedures of Examples 9 and 10, especially when colored fabrics are being washed, the laundry and the wash water in the washing machine are maintained agitated when the detergent composition containing bleach, promoter and brightener are added. This prevents localized over-bleaching or spotting of the laundry. Over-bleaching of dyed fabric is also minimized by the maintenance of the pH of the wash water in the 9 to 10 range, preferably at 9.5, which is the pH resulting from the washing of an average soiled laundry load with the amounts of the detergents described. In some instances, as when excessively soiled or acidic laundry is washed, the proportion of builder salt or its type is changed so as to maintain the pH in the mentioned range during the entire wash period. Thus, a 10 to 20% increase in the builder salt content is employed or 10% of the phosphate builder is replaced with carbonate or other suitable alkaline compound. Alternatively, the alkalinity of the silicate or its content may be increased. In all such cases, when the experiments of Examples 9 and 10 are repeated, excellent detergency, accompanied by satisfactory bleaching and brightening, are obtained without any damage to materials washed or changes in colors thereof.

When, in any of the proceding examples, variations are made in composition components, within the ranges previously described, satisfactory cleaning, bleaching and brightening are obtained, also without damage to the materials washed and without objectionable changes in the colors thereof. Thus, when pentasodium tripolyphosphate and tetrasodium pyrophosphate are interchanged little difference in bleaching or brightening is observable. The proportions of silicate may be increased and the type of silicate may be changed. Instead of sodium carbonate, in high builder content formulas sodium bicarbonate may be employed. Instead of the described synthetic organic detergents, other alkali metal salts, e.g., potassium salts, may be utilized and in place of the alkyl benzene sulfonates there may be substituted paraffin sulfonates, olefin sulfonates, higher fatty alcohol sulfates, sulfated ethoxylated higher fatty alcohols or suitable mixtures thereof. Likewise, the nonionics may be replaced by others named or described herein, e.g., Plurafac B-26, Pluronic F-68, Igepal CO-630 or other Plurafacs, Pluronics, Igepals or Alfonics or similar compounds. Similarly, instead of sodium carboxymethyl cellulose other anti-redeposition agents or gums may be employed, e.g., polyvinyl alcohol, polyvinyl pyrrolidone, hydroxypropylmethyl cellulose. The peroxymonosulfate may be changed to the sodium salt rather than the potassium salts, which are utilized in all the working examples. Similarly, the bromide may be present in a builder or other salt instead of being charged separately and other bromides may be used. Sodium bromide may be changed to potassium bromide. Finally, the physical form may be changed to a pressed tablet, a premeasured charge in a water soluble package or other suitable form and/or the product may be employed as a bleach, hard surface cleaner or laundry pre-soak, with similar good results. In such cases of interchange essentially the same detersive, bleaching and brightening effects result, as they do when modifications of the formulas are made within the proportional ranges previously given and with equivalent or alternate compounds being employed.

The physical properties and stabilities of the present detergents are satisfactory for commercial applications. The particulate products are sufficiently free flowing and do not objectionably cake upon storage. Although bleach products are usually sensitive to the presence of moisture the present product can tolerate the mentioned proportions of moisture in the beads thereof, providing that a satisfactory barrier type carton is employed to prevent transmission of moisture to the detergent composition from high humidity surroundings. Of course, after use the carton of detergent should be closed tightly to prevent any deterioration thereof.

The invention has been described with respect to examples and illustrations thereof but is not to be limited to these because it is evident that one of ordinary skill in the art to which the invention pertains will be able to utilize substitutes and equivalents without departing from the spirit of the invention or the scope of the claims.

What is claimed is:

1. A bleaching and brightening detergent composition comprising by weight about 7 to 30 parts of water soluble synthetic organic detergent selected from the group consisting of anionic detergents, nonionic detergents and mixtures of anionic with nonionic organic detergents, about 9 to 70 parts of water soluble builder salt(s) selected from the group consisting of alkali metal silicates, pyrophosphates, tripolyphosphates, citrates, bicarbonates, and carbobates, about 2 to 80 parts of water soluble alkali metal peroxymonosulfate bleaching agent promoted by about 0.05 to 1.5 equivalent proportions of a water soluble alkali metal bromide per equivalent proportion of active oxygen in the peroxymonosulfate, and from about 0.05 to 3 parts of organic optical brightening agent(s) selected from the group consisting of a. 4,4'-bis-(4-phenyl-2H-1,2,3-triazol-2-yl)-2,2'-stilbene disulfonic acid and salts thereof,
b. 4-(2-naptho-1,2-triazolyl)-stilbene-2-sulfonic acid and salts thereof, and
c. 2,2'(4,4'-divinylbiphenyl)-dibenzenesulfonic acid and salts thereof, and the sum of the parts is from about 21 to 100.

2. A bleaching and brightening detergent composition according to claim 1, in particulate form, wherein the detergent is an anionic detergent or a mixture of anionic and nonionic detergents with the ratio of anionic to nonionic detergents in such mixtures being from about 0.9:1 to about 20:1, optical brightener (a) is potassium 4,4'-bis-(4-phenyl-2H-1,2,3-triazol-2-yl)-2,2'-stilbene disulfonate, (b) is sodium-2-sulfo-4-(2-naphtho-1,2-triazolyl)-stilbene, and (c) is 2,2'-(4,4'-divinylbiphenyl)-dibenzenesulfonic acid.

3. A composition according to claim 2 which contains about 5 to 30 parts of the 9 to 70 parts of builder salts of an alkali metal silicate builder salt, about 5 to 50 parts by weight of an inert, halide free water soluble filler salt, about 2 to 10 parts of moisture, and in which the anionic detergent is an organic sulfate, sulfonate, phosphate or phosphonate, the nonionic detergent is a polyoxyethylene ethanol of a higher alkanol, middle alkyl phenol or polypropylene oxide condensate, and the sum of the parts is from about 26 to 160.

4. A composition according to claim 3 wherein the anionic detergent is an alkali metal salt, the alkali metal silicate is a sodium silicate having an $Na_2O:SiO_2$ ratio of about 1:1 to 1:3, the filler salt is an alkali metal sulfate salt, the peroxymonosulfate is a potassium salt, and the total of any other materials in the composition is less than about 20 percent thereof.

5. A composition according to claim 4 which comprises 7 to 30% of the synthetic organic detergent, 5 to 30% of the sodium silicate, 2 to 8% of moisture, 9 to 70% of other previously named alkali metal builder salt, 5 to 50% of filler salt and 6 to 30% of a peroxymonosulfate salt of the formula $2KHSO_5.KHSO_4.K_2SO_4$, which is promoted by 0.1 to 1.2 equivalent of alkali metal bromide per equivalent of active oxygen of the peroxymonosulfate, and 0.2 to 2.5% of a mentioned optical brightener or a mixture thereof, and the total amount of adjuvant materials in the composition is less than about 15%.

6. A composition according to claim 5 wherein the optical brightener is potassium 4,4'-bis-(4-phenyl-2H-1,2,3-triazol-2-yl)-2,2'-stilbene disulfonate.

7. A composition according to claim 5 wherein the optical brightener is sodium 2-sulfo-4-(2-naphtho-1,2-triazolyl)-stilbene.

8. A composition according to claim 5 wherein the optical brightener is 2,2'(4,4'-divinylbiphenyl)-dibenzene-sulfonic acid.

9. A composition according to claim 5 which contains as the synthetic organic detergent 9 to 20% of a mixture of an alkali metal linear higher alkyl benzene sulfonate and a nonionic organic detergent in a weight ratio of 3:1 to 15:1, 7 to 20% of sodium silicate having an $Na_2O:SiO_2$ ratio of about 1:2.0 to 1:2.4, 20 to 65% of said other alkali metal builder salt.

10. A composition according to claim 9 wherein the linear alkyl group of the anionic detergent is of 12 to 15 carbon atoms, the nonionic detergent is a higher alkyl polylower alkoxy lower alkanol wherein the higher alkyl group is of 12 to 15 carbon atoms with the molar ratio of the lower alkoxy groups to the higher alkyl group in the range of 7 to 20, the alkali metal bromide salt is sodium bromide.

11. A composition according to claim 10 of the formula:

| | Percent |
|---|---|
| Linear sodium alkylbenzenesulfonate (alkyl group averaging about 13 carbon atoms) | 10.0 |
| Primary alkanol of 14–15 carbon atoms ethoxylated with 11 moles of ethylene oxide per mole of alkanol | 2.0 |
| Sodium soap (a mixture of coconut and tallow fatty acid salts of a 15:85 coconut oil: tallow mix) | 1.0 |
| Sodium silicate ($Na_2O:SiO_2$ = 1:2.35) | 7.0 |

-continued

| | Percent |
|---|---|
| Tetrasodium pyrophosphate | 38.0 |
| Sodium carboxymethyl cellulose | 0.5 |
| Dipotassium salt of 4,4'-bis-(4-phenyl-2H-1,2,3-triazoyl-2-yl)-2,2'stilbene disulfonic acid | 0.28 |
| Water | 7.5 |
| Perfume | 0.3 |
| Sodium sulfate | 33.42. |

12. A method of washing, bleaching and whitening laundry simultaneously which comprises adding a washing, bleaching and brightening quantity of a composition of claim 1 to wash water in a automatic washing machine containing laundry to be washed, while agitating such wash water to prevent localized overconcentrations of such composition in the water which could overbleach and discolor dyed laundry and washing the laundry in such wash water at a pH of about 9 to 10.

* * * * *